US005322215A

United States Patent [19]

Roccaforte

[11] Patent Number: 5,322,215

[45] Date of Patent: Jun. 21, 1994

[54] FLIP-TOP CARTON WITH RECLOSABLE LIP

[75] Inventor: Harry I. Roccaforte, Chicago, Ill.

[73] Assignee: Waldorf Corporation, St. Paul, Minn.

[21] Appl. No.: 44,989

[22] Filed: Apr. 8, 1993

[51] Int. Cl.[5] ..... B65D 5/54; B65D 5/66

[52] U.S. Cl. ..... 229/225; 229/145; 229/160.1; 229/930

[58] Field of Search ..... 229/145, 146, 160.1, 229/223-227, DIG. 4

[56] References Cited

U.S. PATENT DOCUMENTS

| | | | |
|---|---|---|---|
| Re. 26,471 | 10/1968 | Meyers | 229/226 |
| 3,078,030 | 2/1993 | Gorton . | |
| 3,282,492 | 11/1966 | Vergobbi | 229/225 |
| 3,295,742 | 1/1967 | Coe | 229/226 |
| 3,653,582 | 4/1972 | Scully | 229/225 |
| 3,942,712 | 3/1976 | Bundy et al. | 229/225 |
| 4,048,052 | 9/1977 | Tolaas | 229/224 |
| 4,310,093 | 1/1982 | Manser | 229/225 |
| 4,986,420 | 1/1991 | Gunn et al. . | |
| 5,154,343 | 10/1992 | Stone . | |

FOREIGN PATENT DOCUMENTS

| | | | |
|---|---|---|---|
| 1200600 | 7/1970 | United Kingdom | 229/225 |

OTHER PUBLICATIONS

U.S. Patent Application Ser. No. 986,782, filed Dec. 8, 1992, owned by Waldorf Corporation.

*Primary Examiner*—Gary E. Elkins
*Attorney, Agent, or Firm*—Dorsey & Whitney

[57] ABSTRACT

The present invention is a reclosable carton in the form of a rectangular box, having opposed parallel substantially single layer front and rear walls, opposed parallel substantially single layer side walls and a closed bottom end forming a carton body. The carton includes a top end flip-top reclosable hood. The hood includes a hood skirt and is formed by an outside main hood panel foldably connected to the carton body, an inside hood panel foldably and severably connected to the front carton wall and including a transverse fold line defining a front hood skirt panel, and two minor hood forming flaps foldably and severably connected to the carton side walls and foldably connected to the inside hood panel. The transverse fold line extends collinearly across the side panels and the carton is provided with an opening tear strip extending completely across the hood forming panels and flaps and parallel to the transverse fold line. The invention provides a friction group of panels to enhance the frictional engagement between the hood and the carton body to ensure that the hood remains closed after it is opened and reclosed, yet prevents the outermost fold score lines associated with the skirt from expanding outwardly and rupturing.

11 Claims, 3 Drawing Sheets

FLIP-TOP CARTON WITH RECLOSABLE LIP

TECHNICAL FIELD

The present invention relates to cartons for scoopable particulate or granular products such as detergents. More particularly, the present invention relates to a reclosable hooded carton for containing products having a powdered or particulate consistency, wherein the carton opening structure is a hood or flip-top, and wherein, after opening, the hood is held closed by friction.

BACKGROUND OF THE INVENTION

Hooded cartons having a hinged, flip-top cover are well known and generally, although not exclusively, used to contain fungible material, such as soap powder or other particulate material. This type of carton usually of carton usually comprises a box or carton having a cover or hood with a skirt. One example of such cartons is disclosed in U.S. Pat. No. 3,078,030 (to Gorton), wherein the carton is intended to be opened and closed a number of times and, in at least one embodiment of the carton, may have an additional piece of paperboard secured to the upper front portion of the box to engage the top when closed.

U.S. Pat. No. 5,154,343 (to Stone) discloses a flip-top reclosable carton wherein, after opening, the top includes a positive locking arrangement accomplished by means of a cut-out portion on the interior surface of the front wall which includes a proximal flap and an island portion disposed in forcibly displaceable mutual engagement. The Stone patent also notes that in reclosable flip-top or hooded cartons, a relatively common reclosable carton design involves the use of a friction fit between the front panel of the container and the corresponding front panel of the lid hingedly connected to the back panel of the carton. Stone further notes that one problem with such friction fit designs is that the lid may not be held securely closed even though the blank used to form such a reclosable carton is dimensioned to ensure the requisite frictional engagement between the lid and the carton. U.S. Pat. No. 4,048,052 (to Tolaas) discloses a reclosing feature somewhat similar to that disclosed by Stone.

U.S. Pat. No. 4,986,420 (to Gunn et al.) discloses a package for housing granular or similar products wherein a liner sticks up past the outer body of the carton to provide a structure for the lid to rest on in closed position. There is no disclosure of a friction fit to ensure that the top remains closed.

The above-noted patents disclose improvements in reclosable hooded or flip-top cartons, but one problem is that each requires a liner or multi-ply carton wall to prevent the contents from leaking out of the package. While the Stone and Tolaas patents disclose a way to create a positive closure arrangement for a flip-top hooded carton, the arrangement requires additional die cutting and a liner is also required. Because of the required liners and additional die cutting, the consumption of expensive paperboard is increased and the fabrication process is complicated.

A reclosable hooded carton for containing particulate or powdered products which is easy to open and reclose securely, yet which can be produced efficiently and inexpensively, would be a decided improvement over the hooded containers currently available.

SUMMARY OF THE INVENTION

The present invention is an improved hooded reclosable carton, particularly designed for containing particulate or powdered material, such as detergent soap powder or the like. The carton is generally in form of a rectangular box, having opposed parallel substantially single layer front and rear walls, opposed parallel substantially single layer side walls and a closed bottom end structure forming a carton body. The carton includes a top end opening structure comprising a flip-top reclosable hood with a hood skirt. The hood of the carton is formed by an outside main hood panel foldably connected to the carton body at a hinge line creating a foldable connection between the main hood panel and the rear wall of the carton. An inside hood panel is foldably and severably connected to the front carton wall and includes a transverse fold line defining a front hood skirt panel. Two minor hood forming flaps are foldably and severably connected to the carton side walls and foldably connected to the inside hood panel. The transverse fold line extends collinearly across the side panels and the carton is provided with an opening tear strip extending completely across the hood forming panels and flaps parallel to the transverse fold line. The carton includes a friction panel group and is dimensioned to provide frictional engagement between the hood and the carton body to ensure that the hood remains closed after it is opened and reclosed.

A feature of the present invention is that the carton is made from a single piece blank of paperboard, yet offers all the advantages of two-piece lined cartons in that it prevents contents from leaking and provides a friction lock reclose feature for holding the hood in the closed position after it is opened initially. A further feature of the carton of the present invention is a front corner structure which ensures the requisite frictional engagement between the hood and the carton, yet prevents the outermost fold score lines at the corners of the hood skirt from expanding outwardly and rupturing.

Flat blanks that may be folded and secured into the preceding carton configuration are encompassed in the present invention. The blanks may be formed from paperboard of any caliber, or other suitable material.

It is an object of the present invention to provide a reclosable hooded carton for containing powdered or particulate material and preventing the contained material from leaking.

Another object of the present invention is to provide a reclosable hooded carton for containing powdered materials, such as soap powder or the like, that is easy to open, recloses securely, and that prevents the contents from leaking.

Another object of the present invention is to provide a reclosable hooded carton that is easy to open, reclose and reopen, wherein the carton hood includes a skirt that is friction fit to the body of the carton upon reclosing, and wherein the carton includes a front corner structure for ensuring the friction fit yet precluding the rupture of the hood skirt.

Still another object of the present invention is to provide a durable and convenient reclosable hooded carton for providing repeated access to the contents, protecting the contents, and preventing leakage without requiring a liner arrangement, yet a carton that can be manufactured, glued and erected efficiently, resulting in a less expensive carton and conserving natural resources.

A further object of the present invention to provide an improved fold score line for overlapping fold score line structures in a double or multiple layer structure, particularly at the front corners of the present invention, which reduces or eliminates rupturing of the outermost fold score line when the structure is folded or articulated.

Other objects and advantages of the present invention will become more fully apparent and understood with reference to the following specification and to the appended drawings and claims.

DETAILED DESCRIPTION OF THE PREFERRED EMBODIMENT

Figure 2:
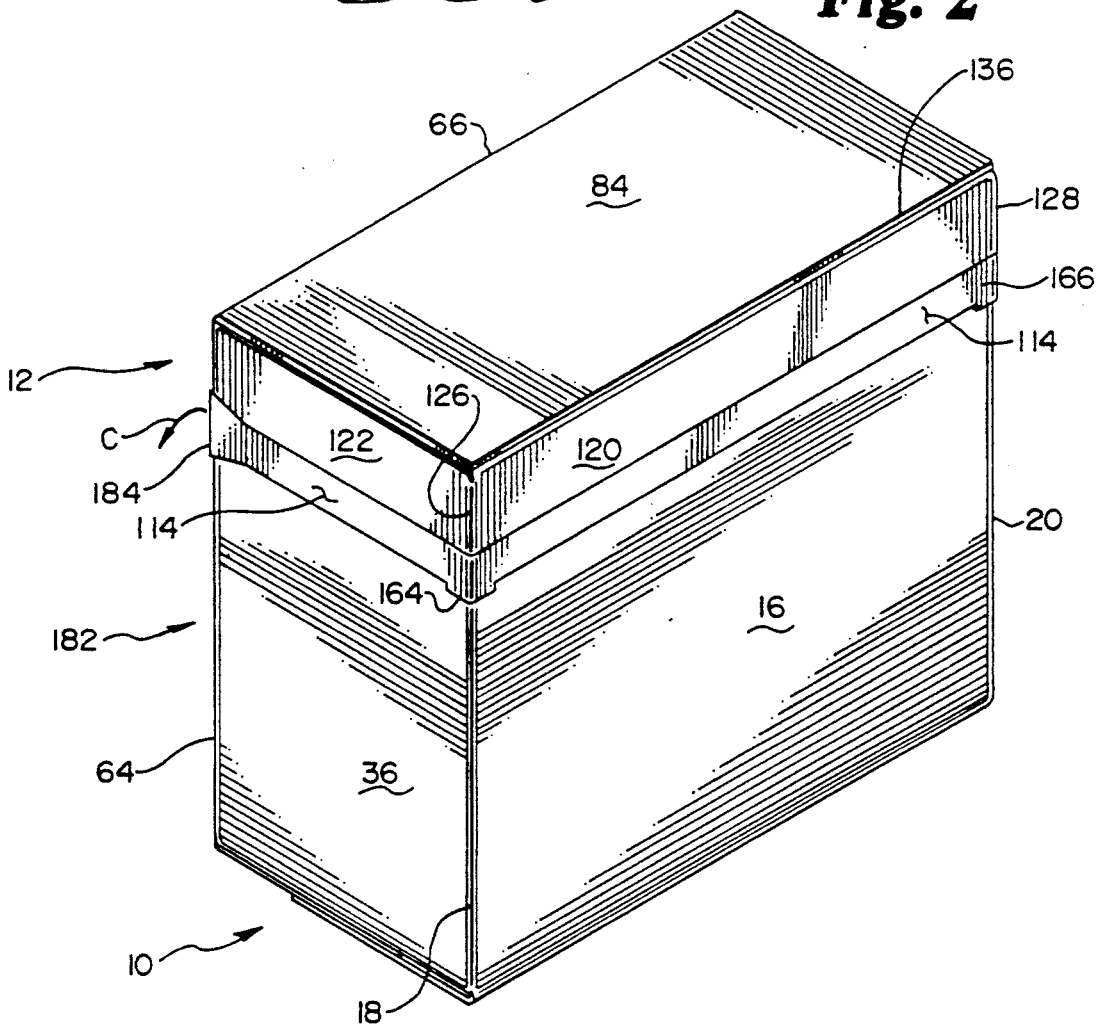
FIG. 2 is a perspective view of the carton of the present invention fully erected and closed.

Referring to FIG. 2, the fully erected preferred embodiment carton 10 in accordance with the present invention is generally tubular with a reclosable, flip-top hooded top end structure 12. The carton 10 has a generally rectangular cross-section and an unobstructed contents containing cavity.

Figure 1:
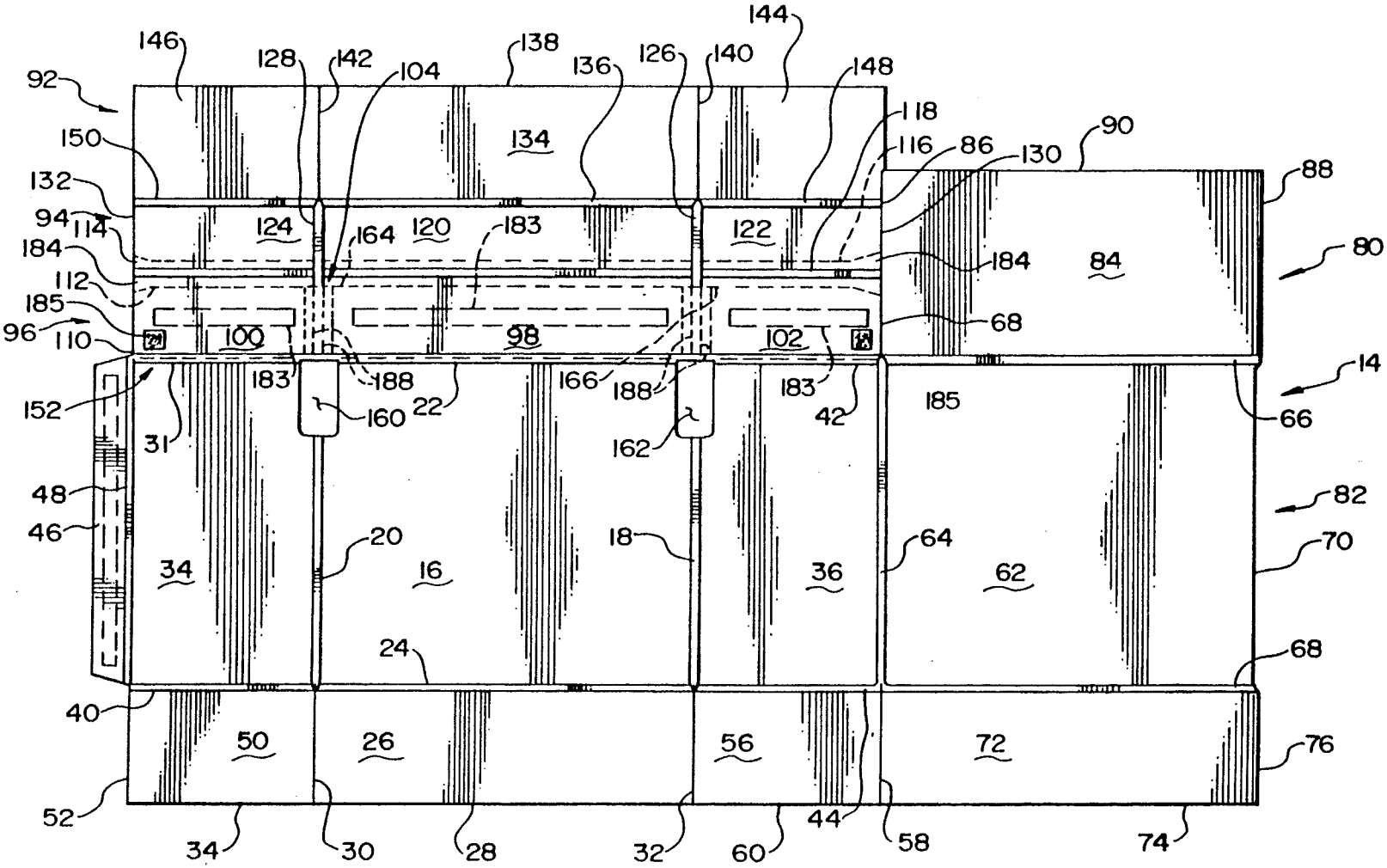
FIG. 1 is a top plan view of the inside surface of the blank from which the carton of the present invention is formed, and depicts the die-cut profile thereof.

FIG. 1 depicts the inside surface of the single-piece flat paperboard blank 14 for forming, in accordance with the present invention, the carton 10. In all of the drawings, double lines indicate scores used to form fold score lines and single solid lines or single dashed lines indicate cuts, perforated or nicked lines, weakened lines or free edges, except where otherwise indicated.

The blank 14 has a generally rectangular front wall panel 16 having two pairs of opposed, generally parallel edges defined by fold lines 18, 20 and 22, 24. A main bottom wall panel 26 is foldably connected to the front wall panel 16 along the fold line 24. The bottom wall panel 26 is further defined by a free edge 28 parallel to the fold line 24 and two parallel opposed side edges 30, 32 generally perpendicular to the fold line 24.

A pair of side wall forming panels 34, 36 is foldably connected to the front wall panel 16 at the opposed, parallel fold lines 20, 18, respectively. The side wall forming panels 34, 36 are further defined by opposed, generally parallel top and bottom fold lines 31, 40 and 42, 44, respectively. The side wall forming panel 34 carries a glue flap 46. The glue flap 46 is foldably connected to the side wall forming panel 34 along a fold line 48, forming the fourth edge of the generally rectangular side wall panel 34. A minor bottom wall forming flap 50 is foldably connected to the side wall forming panel 34 along the fold line 40 and is further defined by free edge 52 collinear with the fold line 48 and free edge 54, collinear with the free edge 28. A second minor bottom wall forming flap 56 is foldably connected to the side wall forming panel 36 along the fold line 44 and is further defined by the free edge 58 and the free edge 60, also generally collinear with the free edge 28.

A generally rectangular rear wall panel 62 is foldably connected to the side wall forming panel 36 along a fold line 64. A rear wall panel 62 is further defined by opposed, generally parallel top and bottom edges formed by fold lines 66, 68, respectively, and a free edge 70 parallel to the fold line 64. The top and bottom fold lines 66, 68 are generally collinear with the fold lines 22, 31 and 42 and 24, 40 and 44, respectively. An inside bottom wall forming panel 72 is foldably connected to the rear wall forming panel 62 along fold line 68 and is further defined by free edges 58, 74 and 76.

With continued reference to FIG. 1, the blank 14 includes a hood forming group 80 at the top end of the generally central portion 82 of the blank 14. The hood forming group 80 includes generally rectangular outermost, main hood forming top wall panel 84 foldably connected to the rear wall panel 62 along the fold line 66. The hood forming panel 84 has generally orthogonal free edges 86, 88 and 90, the latter edge 90 being generally parallel to the fold line 66.

The hood forming group 80 further comprises an interior hood top forming group 92, a skirt group 94 and a friction layer group 96.

The friction layer group 96 includes a inside central front friction panel 98 foldably connected to the front wall forming panel 16 along fold line 22. A pair of inside side friction panels 100, 102 are foldably connected to the side wall panel 34 along fold line 31 and the side wall forming panel 36 along fold line 42, respectively. The inside side friction panels 100, 102 are foldably connected to the front friction panel 98 at foldable hinge areas 104, 106, respectively. Each foldable hinge area 104, 106 is formed by a plurality of fold lines, four in the preferred embodiment, formed by a series of in-line perforations or cuts generally perpendicular to the fold lines 22, 31 and 42. The friction layer group 96 is further defined by free cut edges 108, 110 and a 60% cut score line 112. The cut line 112 is one of the forming cut lines for the tear strip 114, the other forming line of the tear strip 114 being a cut line 116 parallel to the cut line 112. The tear strip 114 may carry a plastic continuous tape 118 for reinforcement and durability. The cut lines 112 and 116 are in the outside surface of the blank 14.

The cut line 116 forms one edge of the skirt group 94. The skirt group 94 comprises an outermost front center skirt panel 120 and two outermost side skirt forming panels 122, 124. The side skirt forming panels 122, 124 are foldably connected to the central skirt forming panel 120 along fold lines 126, 128, respectively, and are further defined by free cut edges 130 and 132. A generally central top inside hood forming panel 134 is foldably connected to the central skirt panel 120 along a fold line 136 and is further defined by a free cut edge 138 parallel to the fold line 136. The side edges of the inside top panel 134 are formed by cut edges 140, 142. Two minor inside top hood forming flaps 144, 146 are foldably connected to the side skirt forming panels 122, 124 along fold lines 148, 150, respectively. The fold lines 148, 150 are generally collinear with the fold line 136 and are parallel to the tear strip 114, in turn parallel to the continuous weakened fold line 152 comprised of the collinear fold lines 22, 38 and 42. The fold line 152 is weakened by a plurality of in-line slits or perforations to facilitate the reverse folding thereof as will be explained hereinbelow. With further reference to FIG. 1, the blank 14 includes two stripped out areas 160, 162. The stripped out areas 160, 162 are generally at the intersection of the fold lines 20 and 152 and 18 and 152, respectively, and are slightly wider than the hinge fold areas 104, 106.

Referring to FIG. 2, and with further reference to FIG. 1, the tear strip 114, particularly the cut line 112 both forming one edge of the tear strip includes deviated cut line portions 164, 166 that form a slight downward extension of the tear strip 114 that will extend beyond the bottom of the stripped out areas 160, 162 when the carton 10 is erected as depicted in FIG. 2.

Figure 3:
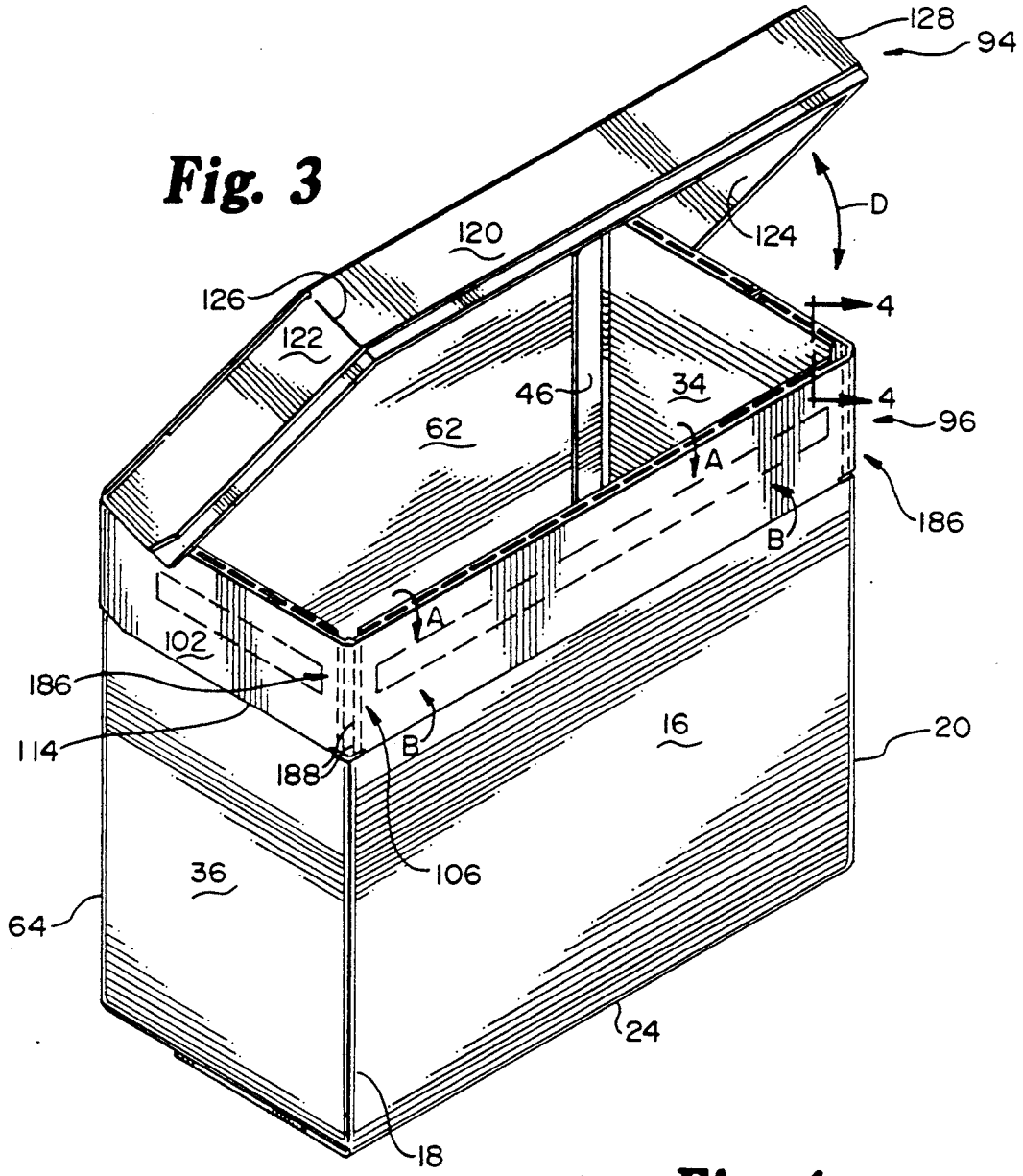
FIG. 3 is a perspective view of the present invention with the hood thereof open to access the contents.

Referring to FIGS. 1-3, the blank 14 of the present invention is foldably erected into the fully formed carton 10 by first folding down the hood top forming group 92, the skirt group 94 and the friction layer group 96 as a planar unit; the folding taking place about weakened fold line 152 as represented by arrows A in FIG. 3. This folding causes the three groups 92, 94 and 96 to assume a position closely adjacent and parallel to the outside surface of the front wall forming panel 16 and the side wall forming panels 34, 36. Next, the blank 14 is reverse folded along cut line 112 which is the lowermost forming line of the tear strip 114. This is represented by arrows B in FIG. 3 and leaves the friction layer group 96 in close proximity to the exterior of the front wall panel 16 and the side wall panels 34, 36. Next, the blank 14 is folded along collinear fold lines 20 and 128 separated by a foldable hinge area 104 until the side wall panel 34 is generally orthogonal with respect to the front wall panel 16. Next, the blank 14 is folded about the fold line 64 until the rear wall panel 62 is generally orthogonal with respect to the side wall forming panel 36. Finally, the blank is folded about fold lines 18 and 126, including the hinge fold area 106, thereby generally tubing the blank 14. The blank is secured in its generally tubular shape by adhesive attachment of the glue flap 46 to the inside of the rear wall panel 62.

The bottom end of the carton is closed by folding minor flaps 50, 56 inwardly until they are orthogonal with the side, front and rear walls of the tubed carton 10 and then folding in panels 26 and 72 and providing adhesive connections among the bottom forming panels 26, 50, 56 and 72 in customary fashion. The top hooded end of the carton is closed by first folding in the minor panels 144, 146 about fold lines 148, 150, respectively, until they are generally perpendicular to side wall forming panels 34, 36. Next, the central inside top panel 84 is folded about fold line 66 and adhesively connected to the side panels 144, 146. Finally, the outside top panel 134 is folded about fold line 136 thereby forming the top hood 12. Thus, the single thickness side walls of the carton 10 indicated generally at 182, the multi-layer hood 12 and the multi-layer carton bottom wall are formed and the carton 10 assumes the configuration depicted in FIG. 2.

To open the carton 10 to access the contents through the hood 12, the user grasps either end 184 of the tear strip 114 and pulls outwardly along the tear strip 114 in either direction depending on which end 184 is used, tearing the strip 114 free along the cut lines 112 and 116. The tear strip 114 is removed entirely and disposed of. After the tear strip 114 is removed, the hood 12 is freed for a range of motion, depicted by arrow D in FIG. 3. The friction layer group 96 including panels 98, 100 and 102, is fixed adhesively to the outside of the front wall panel 16 of the carton 10 above the cut line 112 to form the friction skirt extending around the carton opening. The adhesive connection is represented at areas 183 and 185, and adhesive areas 183, 185 are intended to represent any suitable connective means for use in connecting the overlying portions of the carton 10 as required. The hood 12 is free to rotate about the hinge fold line 66, yet when reclosed after the initial opening, will be held securely closed by the friction between the outside of the friction layer group 96 and the inside of the skirt group 94.

Figure 4:
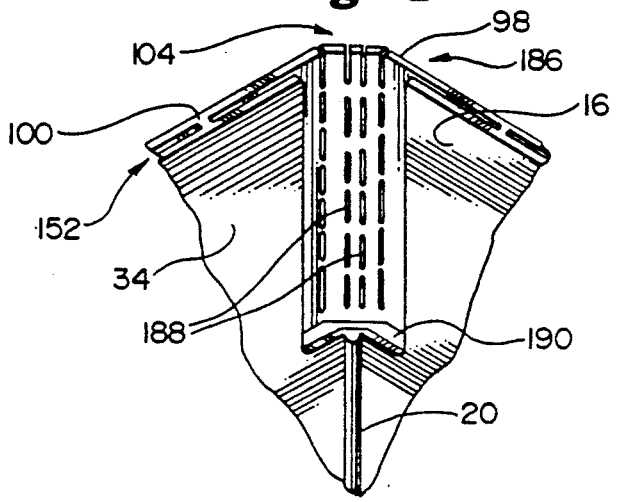
FIG. 4 is a sectional view taken along line 4—4 of FIG. 3.

FIG. 4 depicts a feature of the carton 10 of the present invention. Specifically, it shows the corner structures 186 of the erected carton 10. The advantage of this corner structure 186 enables sufficient friction between the friction layer group 96 and the skirt group 94, yet substantially eliminates rupturing of the skirt group 94 along fold lines 126 and 128 when the carton is fully erected. This is accomplished by the nicked out cut lines of the hinge fold areas 104, 106 being folded inwardly, in the opposite the direction relative to the folding of the fold lines 126, 128. In other words, the central portion of the hinge fold areas 104, 106 are pushed or carried inwardly toward the interior of the carton because the two interior nicked out cut lines 188 at each fold area 104, 106 are spaced outwardly relative to the outer edges of the fold score lines 126, 128. The generally inward expansion of the central portion of the fold hinge areas 104, 106 is enabled by the stripped out areas 160, 162 which underlie the hinge fold areas 104, 106 when the carton is erected, as seen in FIG. 4. The slight gap 190 beneath the hinge fold areas 104, 106 produced by the stripped out areas 160, 162 is closed by the portions of the tear strip 114, specifically, the downwardly extending tab portions defined by the deviated cut lines 164, 166 as shown in FIG. 2. Thus, an advantage of the carton 10 of the present invention is that sufficient friction for holding the hood 12 closed is produced by the double thickness area formed by the friction layer group 96 and the front and side wall panels 16 and 34, 36 of the carton 10, yet the possibility for a rupture of the outer skirt group 94, particularly at fold lines 126, 128 is reduced by relieving the double thickness area with a series of cuts comprising the hinge fold areas 104, 106 and the stripped out areas 160, 162.

Figure 1A:
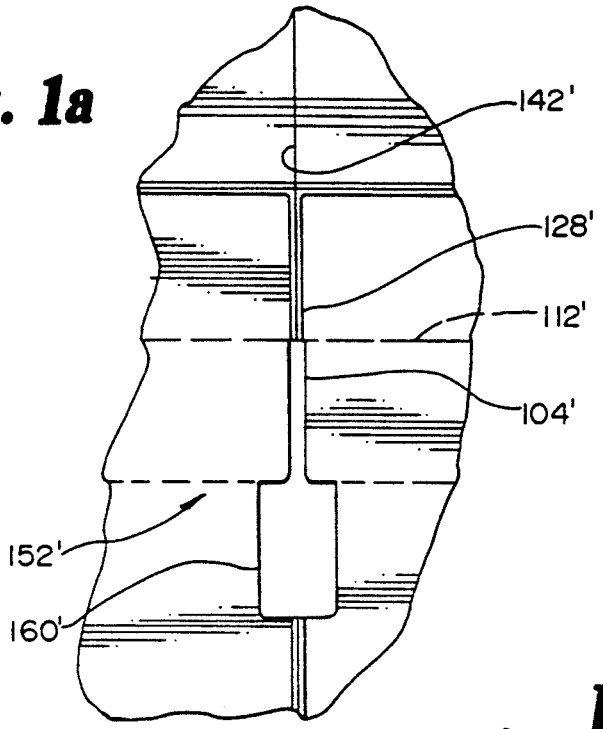
FIG. 1*a* is a fragmentary plan view of a modified form of the present invention.

The present invention also contemplates a carton 10 wherein the contents remain below the stripped out areas 160, 162 and therefore, the hinge fold lines 104, 106 may be stripped out as shown in FIG. 1*a*, reference numbered commonly with the other figures but with a prime indication (for example 160′, etc.).

The present invention may include suitable handles or handle structures on the top or sides of the formed carton 10 and may be embodied in other specific forms without departing from the spirit or central attributes thereof. It is therefore desired that the present embodiment be considered as illustrative and not restrictive, reference being made to the appended claims to indicate the scope of the invention.

What is claimed is:

1. A carton comprising:

front and rear walls, said front and rear walls each having a top edge;

a bottom wall;

opposed side walls extending between and connected with said front and rear walls; and a top wall structure including a reclosable hood pivoted along an axis along the top edge of said rear wall, said reclosable hood comprising:

an outer hood panel foldably connected to the rear wall;

a friction panel group being connected to said front and side walls;

a hood skirt foldably and releasably connected to said friction panel group, said friction panel group underlying said hood skirt and releasably connected thereto along a removable tear strip, said friction panel group being fixedly connected to said front and side walls; and an inside hood panel foldably connected to the hood skirt and underlying the outer hood panel.

2. The carton according to claim 1, including two innermost corners at the connection between each said side wall and the front wall, said corners underlying said friction group and including a stripped out area.

3. The carton according to claim 2, wherein said tear strip includes at least one tab means for overlying at least part of said stripped out area, said tab means extending toward said bottom wall of said carton.

4. The carton according to claim 2, said friction panel group including two middle corners overlying said stripped out areas and including a plurality of parallel fold score lines, said lines being generally parallel to said connection between said each side wall and the front wall and forming an inside fold score region.

5. The carton according to claim 4, said inside fold score region being narrower than said stripped out area.

6. A carton blank comprising:

a generally central portion including a plurality of foldably connected carton body forming panels and having a first end and a second end;

a bottom forming panel group foldably connected to said first end;

a hood forming panel group foldably connected to said second end and including an outside hood panel foldably connected to said central portion at a first score line, a friction panel group foldably connected to said central portion along a second score line collinear with said first score line, a skirt panel group releasably connected to said friction panel group along a removable tear strip parallel to said second score line, and a hood top wall forming panel group foldably connected to said skirt panel group along a score line parallel to said tear strip.

7. The blank according to claim 6, said cuts and scores comprising a plurality of score lines for forming said foldable connections, at least a portion of said score lines adapted to be overlaid, including an overlying score area comprising a plurality of parallel cut lines and an underlying stripped out area score wider than said overlying score area, said underlying stripped out area and overlying score area being aligned with and under at least part of one of said score lines.

8. A carton comprising:

front and rear walls, said front and rear walls each having a top edge;

a bottom walls;

opposed side walls extending between and connected with said front and rear walls; and a top wall structure including a reclosable hood pivoted along an axis along the top edge of said rear wall, said reclosable hood comprising:

an outer hood panel foldably connected to the rear wall;

a hood skirt connected to said outer hood panel;

a friction panel group connected to said front and side walls and foldably and releasably connected to said hood skirt, said friction panel group underlying and substantially coextensive with said hood skirt; and an inside hood panel foldably connected to the hood skirt and underlying the outer hood panel.

9. The carton according to claim 8, wherein said friction panel group and said hood skirt extend substantially continuously and coextensively about said front and side walls.

10. The carton according to claim 9, wherein said friction panel group is releasably connected to said hood skirt along a removably tear strip, said friction panel group being fixedly connected to said front and side walls.

11. The carton according to claim 10, including two innermost corners at the connection between each said side wall and the front wall, said corners underlying said friction group and including a stripped out area.

* * * * *